United States Patent [19]

Crozet et al.

[11] Patent Number: 4,925,365

[45] Date of Patent: May 15, 1990

[54] TURBINE STATOR RING ASSEMBLY

[75] Inventors: Francois E. G. Crozet, Yerres; Jean-Luc Soupizon, Vaux Le Penil, both of France

[73] Assignee: Societe Nationale D'Etude et de Construction de Moteurs D'Aviation "SNECMA", Paris, France

[21] Appl. No.: 393,796

[22] Filed: Aug. 15, 1989

[30] Foreign Application Priority Data

Aug. 18, 1988 [FR] France ..... 88 10977

[51] Int. Cl.[5] ..... F01D 11/02; F04D 29/54

[52] U.S. Cl. ..... 415/173.6; 415/139; 415/170.1; 277/53

[58] Field of Search ..... 415/170.1, 173.3, 173.3, 415/173.4, 173.6, 173.7, 173.5, 177, 170 R, 139

[56] References Cited

U.S. PATENT DOCUMENTS

| | | | |
|---|---|---|---|
| 3,603,599 | 9/1971 | Laird | 277/53 |
| 3,880,550 | 4/1975 | Corey et al. | 415/173.4 |
| 3,966,354 | 6/1976 | Patterson | 415/173.4 |
| 4,295,787 | 10/1981 | Lardellier | 415/173.6 |
| 4,425,079 | 1/1984 | Speak et al. | 415/139 |
| 4,623,298 | 11/1986 | Hallinger et al. | 415/173.7 |
| 4,648,792 | 3/1987 | Baran, Jr. et al. | 415/139 |

FOREIGN PATENT DOCUMENTS

| | | |
|---|---|---|
| 0017546 | 10/1980 | European Pat. Off. . |
| 2407342 | 5/1979 | France . |
| 2407343 | 5/1979 | France . |
| 839915 | 6/1960 | United Kingdom . |
| 2115487 | 9/1983 | United Kingdom . |
| 2151709 | 7/1985 | United Kingdom . |

*Primary Examiner*—Robert E. Garrett
*Assistant Examiner*—Hoang Nguyen
*Attorney, Agent, or Firm*—Oblon, Spivak, McClelland, Maier & Neustadt

[57] ABSTRACT

A stator ring assembly for a turbine comprising a plurality of sections, each section has a first sheet metal portion being connected to a second sheet metal portion, and a support ring of generally S-section defining a radially outer edge portion of the second sheet metal portion co-operating with the support ring.

4 Claims, 2 Drawing Sheets

TURBINE STATOR RING ASSEMBLY

BACKGROUND OF THE INVENTION

1. Field of the Invention

This invention relates to a turbine stator ring assembly, for example for the low pressure turbine of a turbofan, associated with a support for connection to the turbine casing.

2. Summary of the Prior Art

In a turbine, and in the case of a turbine intended for aeronautical applications, it is usual to provide between the tips of the turbine rotor blades and the turbine casing proper which constitutes the envelope and the support for the elements of the stator, particularly of the fixed blades, a stationary, generally annular part which carries an abradable sealing member lying opposite to the tips of the rotor blades, and which will be termed herein a "turbine ring".

A diversity of means have been proposed for mounting such turbine rings on their casing. French patent publication Nos. 2 407 342 and 2 407 343 illustrate an example of such a turbine ring assembly in which the support of a turbine ring is formed by a segmented ring secured by ties on an outer envelope and, on its downstream edge portion, by a radial flange of the said envelope and an edge portion of the adjacent nozzle guide blade stage.

FIG. 1 also illustrates the forward part, in longitudinal section, of the low pressure turbine of a known turbofan. At the first stage 1 of the turbine rotor, a turbine ring assembly 2 is mounted on an annular support 3 which is bolted on an upstream flange 4 of the turbine casing 5. A layer 6 of insulating material may be placed between the ring 2 and its support 3.

An object of the invention is to improve the thermal insulation of the casing and of the ring support itself while reducing mass which is a choice criterion particularly important in aeronautical applications.

Another object is to render the ring support independent of the turbine casing.

SUMMARY OF THE INVENTION

According to the present invention there is provided in a turbine stator ring assembly for mounting within a turbine casing a plurality of sections built up to form the ring, each section comprising a first sheet metal portion extending generally axially of the turbine and having a downstream edge portion and an upstream edge portion, abradable sealing material supported by said first portion, and a second sheet metal portion extending generally radially of the turbine and having a radially inner edge portion and a radially outer edge portion, the radially inner edge portion of the second sheet metal portion being rigid with the upstream edge portion of the first sheet metal portion, and a support ring of generally S-section defining a radially outer groove arranged to co-operate with a part of the turbine casing, and the radially outer edge portion of the second sheet metal portion co-operating with the support ring.

DESCRIPTION OF THE PREFERRED EMBODIMENT

Figure 1:
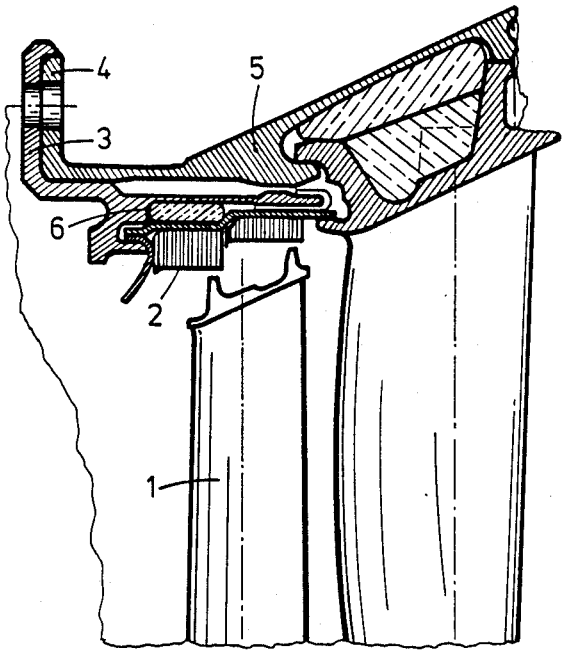
FIG. 1 is a longitudinal section in a plane passing through the axis of rotation of the turbine of a forward part of a low pressure turbine of a turbofan of known type, showing a previously proposed construction of a turbine stator ring assembly as mounted within a turbine casing.
Figure 2:
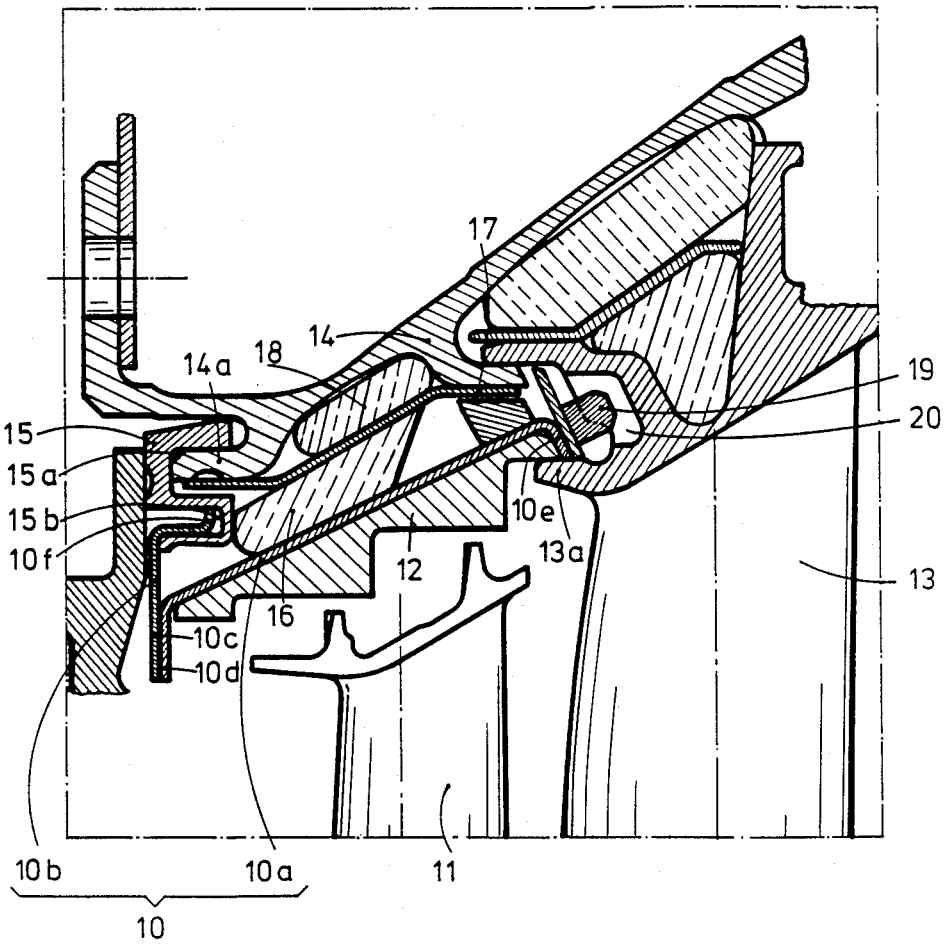
FIG. 2 is a sectional view similar to FIG. 1 but illustrates a stator ring assembly according to the invention as mounted within a turbine casing.

Referring to FIG. 2, a turbine stator ring, generally denoted by reference 10 is built up circumferentially from a plurality of sections, for example eighteen in the example illustrated. Each section comprises two sheet metal, part-annular, portions, the first portion 10*a* generally extending in a longitudinal direction relative to the turbine axis of rotation and a second portion 10*b*, generally extending in a radial direction. The radially inner part 10*c* of section 10*b* is made rigid, for example by welding, with an upstream part 10*d* of the first portion 10*a*. Each first portion 10*a* carries, on its inner face and opposite to the tips of the rotor blades 11 of the first turbine rotor stage, an abradable seal member 12. A downstream edge portion 10*e* of each first portion 10*a* engages a projecting upstream edge part 13*a* of the outer platforms of the turbine nozzle guide blades 13.

The turbine casing 14 has adjacent its upstream end an annular internal flange 14*a* which engages in a radially outer groove 15*a* of a support ring 15 which has an S-shaped cross-section. This support 15 comprising a slit (not shown) which enables freedom for thermal expansion. The radially outer edge of each second section 10*b* has a flange 10*f* which co-operates with the radially inner groove 15*b* of the S-section support ring 15.

The turbine ring 10 is thus suspended between the support ring 15 and the nozzle guide blade platforms 13*a*.

Between the turbine casing 14 and the turbine ring 10 a space is provided which enables application on the outer face of the first section 10*a* of a first layer 16 of heat-insulating material which is covered with a sheet metal member 17 of generally annular shape, which itself has applied to it a second layer 18 of heat-insulating material.

The forward part of the turbine which has a stator ring assembly in accordance with the invention can be assembled in the manner described hereinafter. The support ring 15 is mounted on the turbine casing 14; the second layer 18 of heat-insulating material is applied within the casing; the sheet metal member 17 is placed in position, then the first layer 16 of heat insulating material is applied to it. Subsequently, the downstream edge portions 10*e* of the turbine ring 10 sections are tilted towards the axis of rotation of the turbofan, then the said sections are engaged on the upstream side in the inner groove 15*b* of the support ring 15 and moved axially until they engage the bottom of the groove 15*b* of the support ring 15 and the downstream edge 10*e* is tilted back outwards.

The downstream edge portion 10*e* of the first portion 10*a* of each section carries in addition an anti-rotation locking device 19 which is then used to position them angularly, such locking devices 19 being held with a set of tools.

The first rotor stage 11 is then assembled, and then the nozzle guide blade assembly 13 which has on the upstream side of the outer ring a recess 20 co-operating with the locking devices 19 by means of which the turbine ring 10 is locked against rotation.

What is claimed is

1. In a turbine stator ring assembly for mounting within a turbine casing a plurality of sections built up to form the ring, each section comprising a first sheet metal portion extending generally axially of the turbine and having a downstream edge portion and an upstream edge portion, abradable sealing material supported by said first portion, and a second sheet metal portion extending generally radially of the turbine and having a radially outer edge portion, the radially inner edge portion of the second sheet metal portion being rigid with the upstream edge portion of the first sheet metal portion, and a support ring of generally S-section defining a radially outer groove arranged to co-operate with a part of the turbine casing, and the radially outer edge portion of the second sheet metal portion co-operating with the support ring.

2. An assembly according to claim 1, comprising a first layer of heat-insulating material applied to the outer face of each said first portion of each said section, a sheet metal member of generally annular shape applied by its inner face to said first layer, and a second layer of heat-insulating material applied to the outer face of the annular sheet metal member.

3. An assembly according to claim 1 wherein the said support ring has a slit to facilitate thermal expansion.

4. An assembly according to claim 1 comprising an anti-rotation locking device mounted on the downstream edge portion of each first portion of each ring section, the locking devices being arranged to co-operate with recesses provided in the upstream edge of the adjacent turbine nozzle guide assembly.

* * * * *